US005947396A

United States Patent [19]

Pierce

[11] Patent Number: 5,947,396

[45] Date of Patent: Sep. 7, 1999

[54] COLLIDER

[76] Inventor: Melvin E. Pierce, 9501 Spice Pond Rd. Extension, Semmes, Ala. 36575

[21] Appl. No.: 09/004,453

[22] Filed: Jan. 8, 1998

[51] Int. Cl.[6] ..... B02C 13/04

[52] U.S. Cl. ..... 241/32; 241/187; 241/188.1

[58] Field of Search ..... 241/188.1, 32, 241/187

[56] References Cited

U.S. PATENT DOCUMENTS

| | | | |
|---|---|---|---|
| 180,149 | 7/1876 | Moore . | |
| 313,337 | 3/1885 | Jesse . | |
| 442,815 | 12/1890 | Meakin . | |
| 571,588 | 11/1896 | Albrecht . | |
| 592,090 | 10/1897 | Harrell . | |
| 646,252 | 3/1900 | Andree . | |
| 664,851 | 1/1901 | Green . | |
| 812,122 | 2/1906 | Fassett . | |
| 1,006,573 | 10/1911 | Lockwood . | |
| 1,212,418 | 1/1917 | Sturtevant . | |
| 1,635,453 | 7/1927 | Agnew . | |
| 1,636,033 | 7/1927 | Agnew . | |
| 1,714,132 | 5/1929 | Molz . | |
| 2,360,086 | 10/1944 | Thurman et al. . | |
| 2,424,316 | 7/1947 | Johnston . | |
| 2,670,775 | 3/1954 | Elofson . | |
| 2,705,596 | 4/1955 | Poyser | 241/32 |
| 2,903,192 | 9/1959 | Clausen . | |
| 3,011,220 | 12/1961 | Keller et al. . | |
| 3,398,901 | 8/1968 | O'Connor et al. . | |
| 3,806,047 | 4/1974 | Ober . | |
| 3,927,840 | 12/1975 | Nash . | |
| 3,966,126 | 6/1976 | Werner . | |
| 3,987,970 | 10/1976 | Burkett . | |
| 4,082,231 | 4/1978 | Gould . | |
| 4,614,308 | 9/1986 | Barclay . | |
| 5,109,933 | 5/1992 | Jackson . | |
| 5,129,469 | 7/1992 | Jackson . | |
| 5,400,977 | 3/1995 | Hayles, Jr. . | |
| 5,544,820 | 8/1996 | Walters | 241/188.1 |

*Primary Examiner*—Mark Rosenbaum
*Attorney, Agent, or Firm*—Bergert & Bergert

[57] ABSTRACT

A material collider system for reducing the size of solid particulate material fed into the system is disclosed. The collider system includes a pair of interconnected cylindrical chambers each having a rotatable rotor assembly which includes a plurality of disc sets and rigidly mounted thrust guides. The rotor assemblies are aligned in parallel relation and operate in a counter rotating manner. The thrust guides are mounted to the disc sets so as to extend radially outwardly of the disc sets and each thrust guide is maintained in a substantially rigid position by a shear pin. In one embodiment, the thrust guides of the two rotors are arranged in an alternating, interdigitating pattern. The disc sets may be offset along the length of the rotor assemblies such that the thrust guides form a 360 degree spiral pattern. The rotor assemblies are operated by motors secured outside of the chambers. Sealing means prevent materials from escaping the chambers and causing damage to the drive system of the material collider.

34 Claims, 11 Drawing Sheets

COLLIDER

BACKGROUND AND SUMMARY OF THE INVENTION

The present invention is related to a material collider, and more particularly to a material collider apparatus which can break down materials received into the apparatus, such as drill cuttings from a wellbore, to a reduced particle size for further use such as by reinjection of the refined cuttings down a wellbore.

Drill cuttings are an inevitable by-product of well drilling and their disposal has been a longstanding problem. Offshore drilling operations, in particular, are problematic because of the need to transport the cuttings to a landfill or a shore-based processing system.

One solution to this problem is disclosed in U.S. Pat. Nos. 5,109,933 and 5,129,469. These patents describe systems for disposing of drill cuttings by mixing the cuttings with a carrier liquid such as water, and reducing the size of the cuttings in a pump having an impeller of a backward swept blade type to form a slurry of the particles and the carrier liquid for injection into a well for disposal.

Other types of pulverizers and material breaking machinery are described, for example, in the following U.S. Pat. Nos.: 180,149 to Moore; 313,337 to Jesse; 442,815 to Meakin; 1,006,573 to Lockwood; 1,212,418 to Sturtevant; 1,635,453 to Agnew; 1,636,033 to Agnew; 2,903,192 to Clausen; 3,398,901 to O'Connor et al.; 3,806,047 to Ober; 3,966,126 to Werner; and 5,400,977 to Hayles, Jr.

The present invention provides a material collider apparatus for reducing the particle size of inserted particulate solid materials such as drill cuttings from a wellbore.

It is thus one object of the present invention to provide a material collider for use in a drill cuttings disposal system which can reduce the cuttings to the appropriate size in one pass of the cuttings through the material collider.

It is a further object of the present invention to provide a material collider for use in a drill cuttings disposal system having parallel, counter-rotating rotors each having a plurality of rigidly mounted thrust guides which intermesh and cause reduction in size of the drillings by impact and shear on the thrust guides and assist in the collision of the drill cuttings with one another while passing through the system.

It is another object of the present invention to provide a material collider for use in a drill cuttings disposal system wherein the material collider is provided with sealing means to minimize material spillage and flow to the bearings and the shafts.

It is a further object of the present invention to provide a material collider which may be advantageously employed in pulverizing various materials, such as drill cuttings, agricultural products and various types of minerals.

DESCRIPTION OF THE PREFERRED EMBODIMENTS

Figure 1:
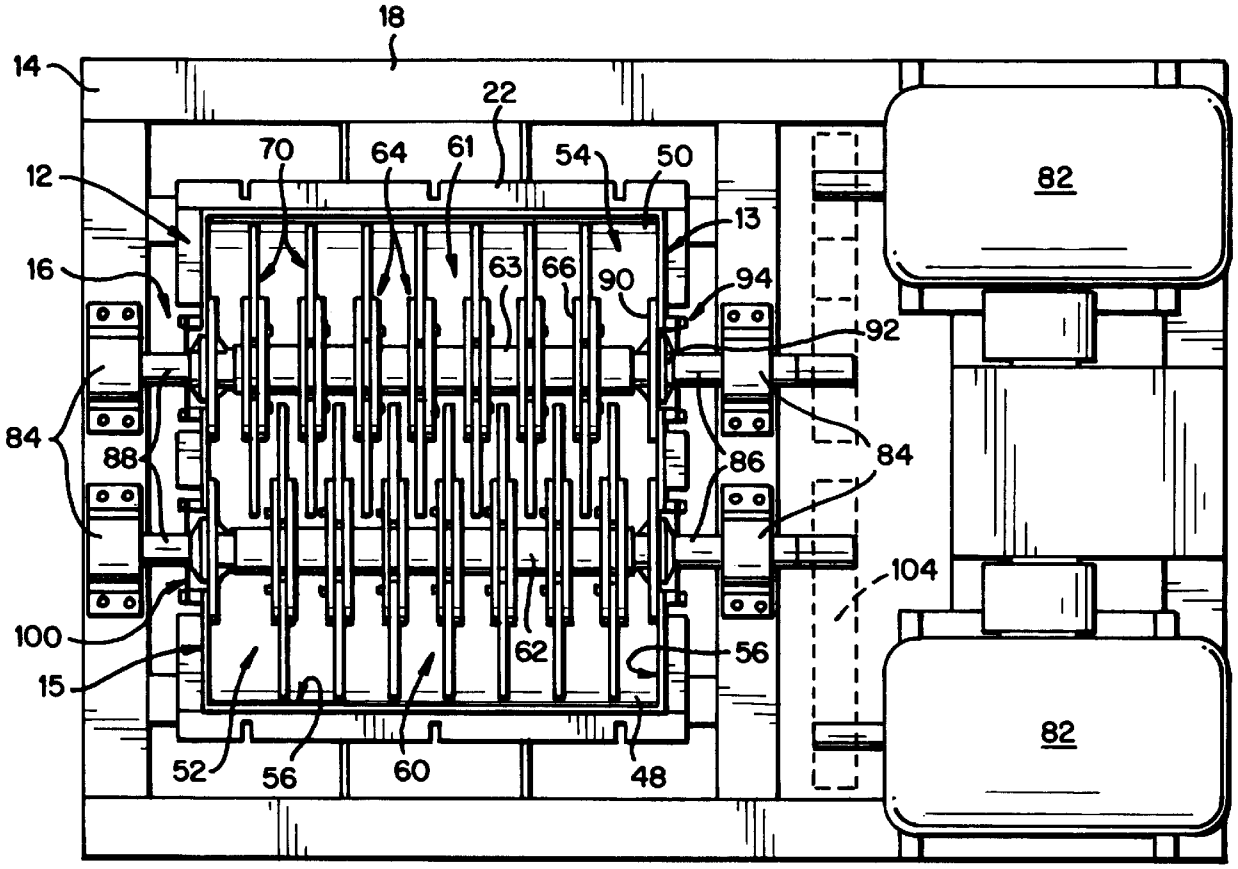
FIG. 1 is a top schematic view of the collider of the present invention.

In the embodiment of the present invention as shown in FIGS. 1 through 10*g*, there is provided a material collider 10 including a housing assembly 12 securely mounted to a baseframe assembly 14. The housing 12 and baseframe 14 assemblies may be formed of structural steel, for example, and the housing assembly 12 is secured to the baseframe assembly 14 so as to rest partially within a cavity 16 in the baseframe assembly 14. The baseframe assembly 14 is provided with support beams 18 which can be at least eighteen inches in height to provide balance and stability as well as to reduce vibration during operation of the collider.

As shown in FIGS. 3 through 6, the housing assembly 12 is formed of a two-piece construction, including a top section 20 and a bottom section 22 so as to allow the top section to be removed in circumstances requiring cleaning or replacing of components within the housing assembly 12. A sealing member 24 is positioned between the top 20 and bottom 22 sections of the housing assembly and cooperates with wedgelocks 26 to securely maintain the top 20 and bottom 22 sections together. Lifting eyes 28 are provided on the top section 20 of the housing assembly 12 to allow the top section of the housing assembly to be removed, such as by a jib hoist, for example.

The housing assembly top section 20 has a feed inlet opening 30 and an inspection opening 32 and the bottom section 22 includes a material discharge opening 34 and a cleanout trough 36. A feed inlet chute 38 and an inspection door 40 are secured to the top section 20 above the feed inlet 30 and inspection openings 32, respectively. A material discharge outlet 42 is secured to the bottom section 22 below the discharge opening 34.

The feed inlet chute 38 is sufficiently large to allow the collider 10 to receive materials of widely varying sizes, wet or dry, and is provided with an input port for receiving water injection. The material outlet 42 is sufficiently large to allow as much material to be discharged as is fed into the collider 10. The inspection door 40 is hingedly secured to the top section 20 and maintained in place by a wedgelock 26. The inspection door 40 permits an operator to view the housing interior 46 without having to remove the housing top section 20. The feed inlet chute 38 and the material outlet 42 may be secured to the housing by traditional means such as by bolts or welding or the like.

Figure 5:
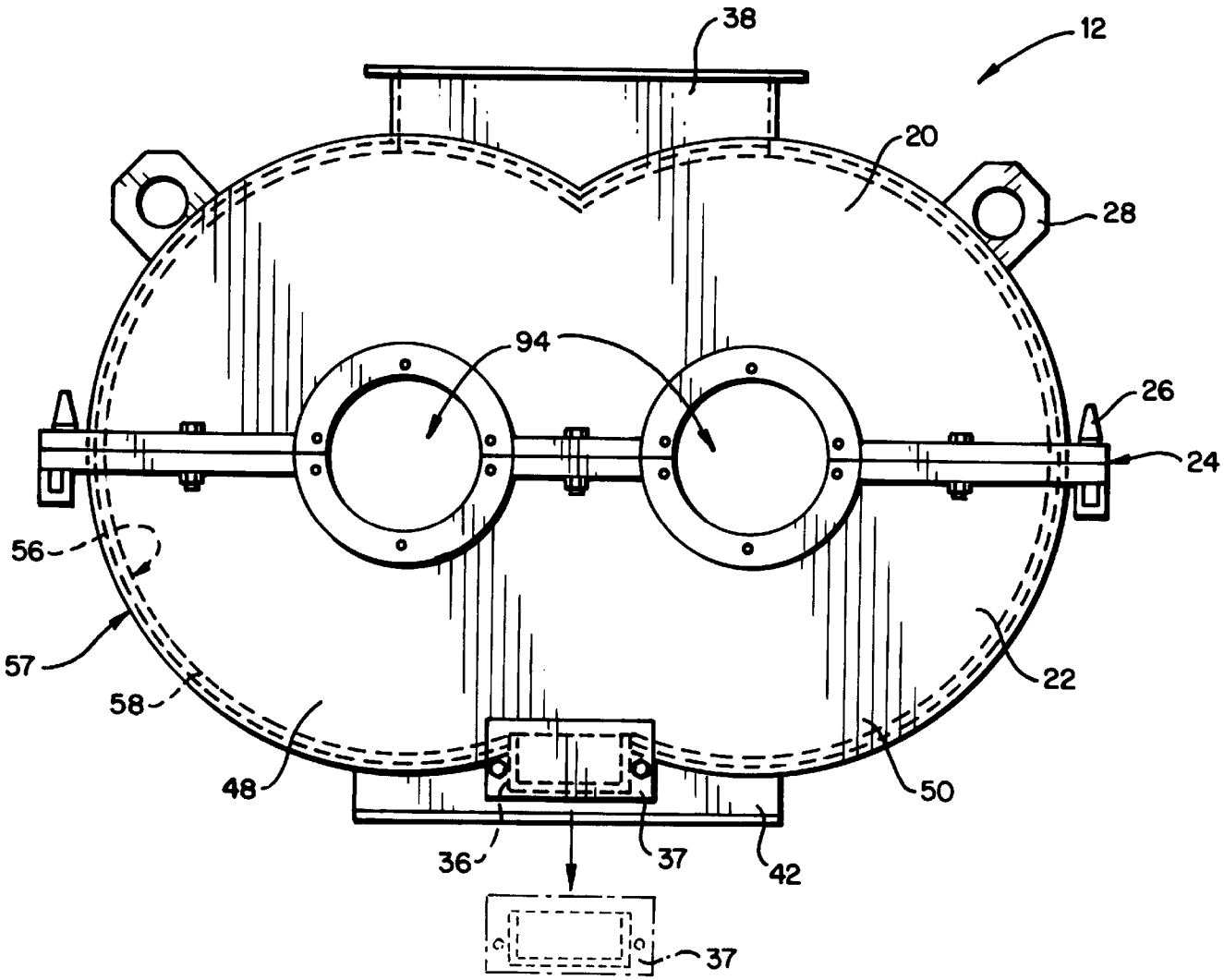
FIG. 5 is a right side elevation view of the housing assembly of the present invention, with the removable cleanout cover shown in phantom.
Figure 6:
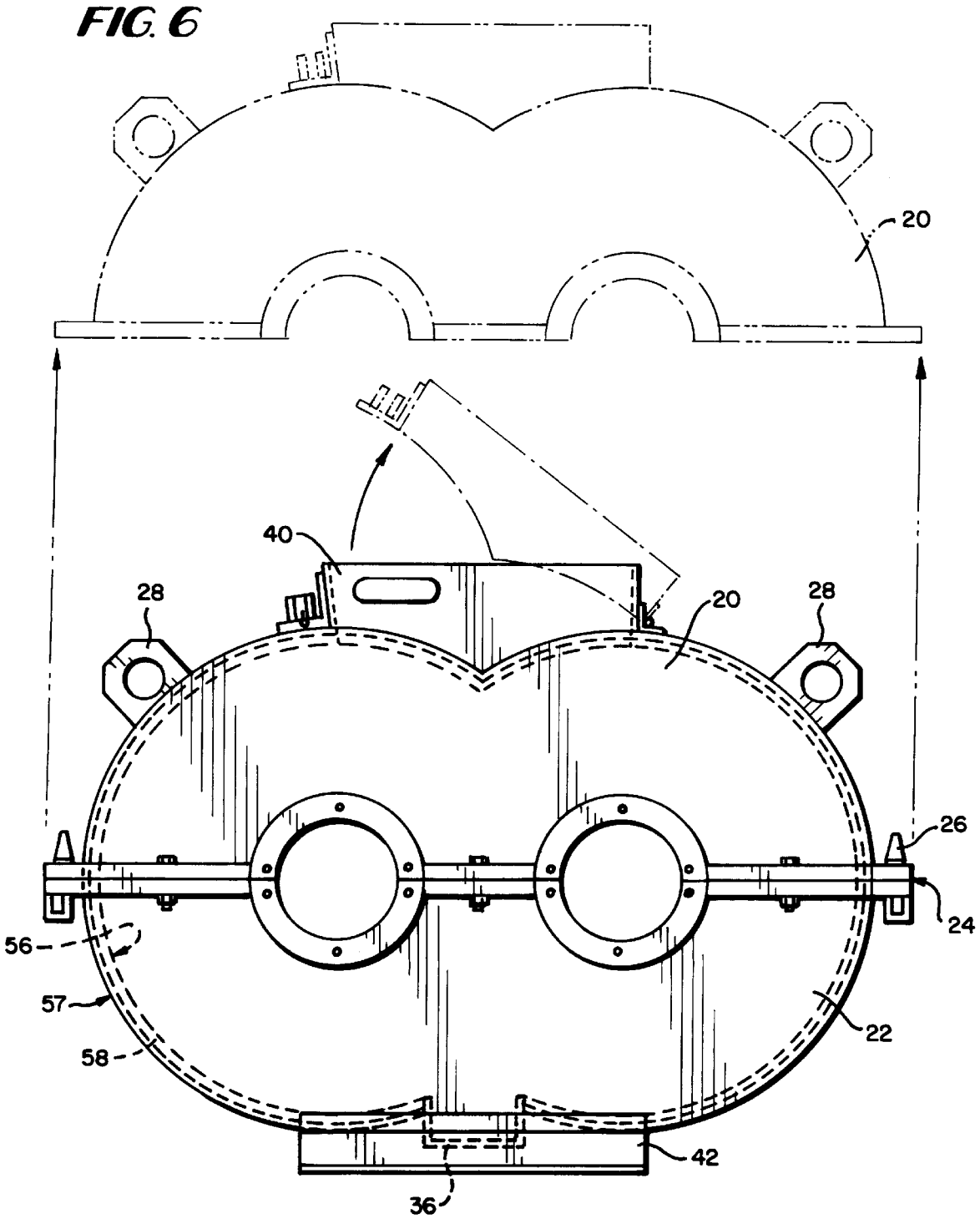
FIG. 6 is a left side elevation view of the housing assembly of the present invention, with phantom lines showing the inspection door in the open position and the top section of the housing assembly removed.

As shown in FIGS. 5 and 6, when the top 20 and bottom 22 sections of the housing assembly are secured together, the housing assembly 12 takes the form of a pair of overlapping cylindrical tanks 48, 50 having substantially a figure-eight shape in cross section, thus providing respective housing chambers 52, 54 which are in fluid communication. The housing assembly internal wall 56 may be lined with replaceable wear liners or wear plates 58 which are of a harder grade steel than the housing assembly for preventing damage to the housing internal 56 and external 57 walls during operation of the collider. In one embodiment of the invention, these wear plates 58 have a thickness of one-half inch. The wear plates 58 may be secured to the housing assembly interior by bolts, for example.

Figure 8:
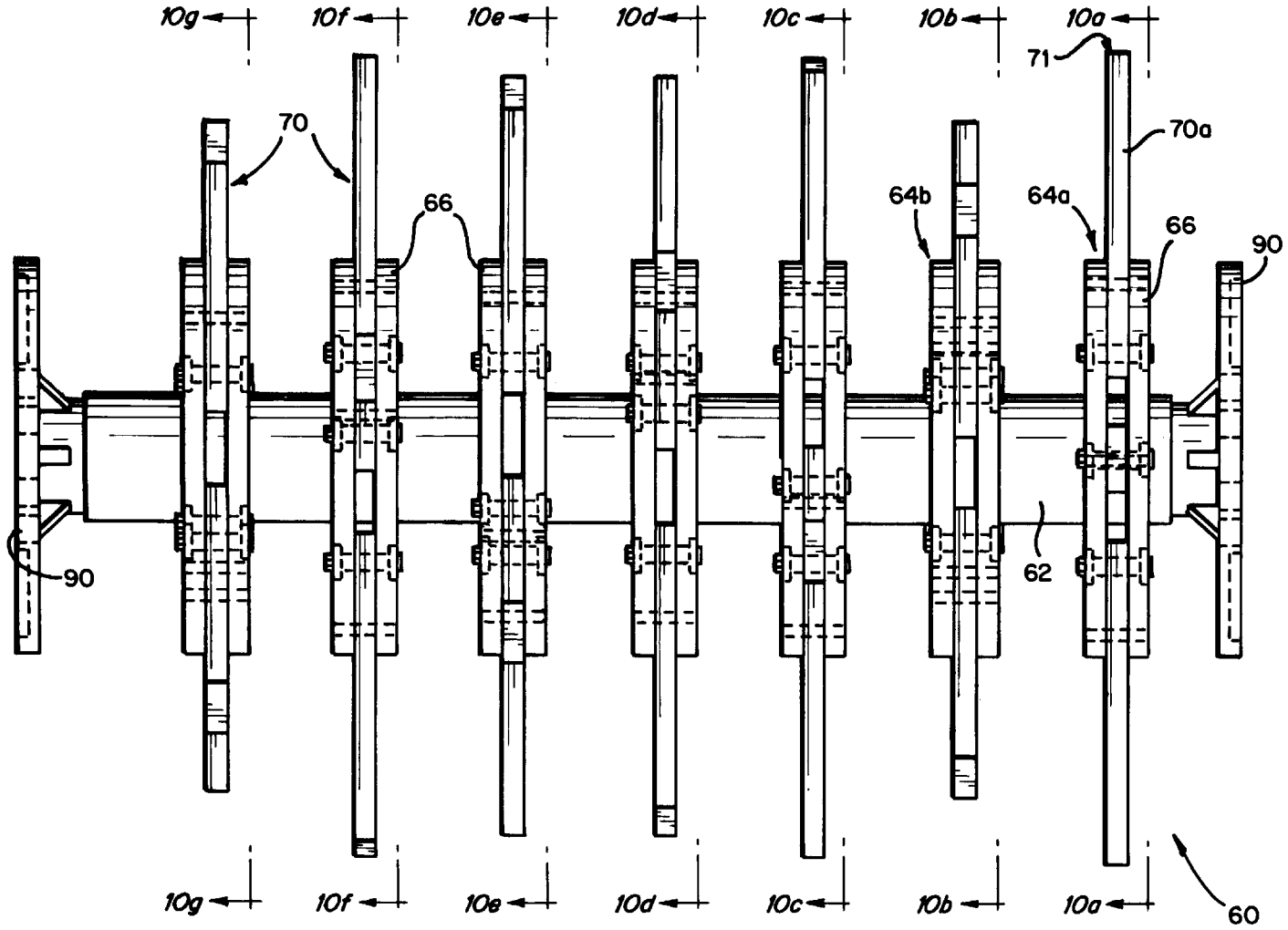
FIG. 8 is a front elevational view of one rotor assembly of the present invention.

As shown in FIG. 1, a pair of rotor assemblies 60, 61 are maintained within the housing assembly 12 and cooperate to force materials fed into the feed inlet to collide with one another and produce a finely ground material which is then dispensed through the material outlet. Each rotor assembly 60, 61 includes a rotor 62, 63 which is axially positioned within a respective housing chamber 52, 54 so as to extend in parallel relation to one another throughout the length of the chambers 52, 54. In one embodiment of the invention, the longitudinal axis of each rotor assembly is coplanar with the seal 24 between the top and bottom portions of the housing assembly. To reduce the likelihood of rotor deflection, which can cause excessive vibration and ultimately catastrophic failure, each rotor 62, 63 has an internal diameter of at least six inches. As shown in FIGS. 1 and 8, the rotor assemblies 60, 61 are also provided with an easily maintainable and interchangeable system of disc sets 64 and thrust guides 70, wherein the disc sets are mounted at evenly spaced intervals along the length of each rotor 62, 63.

Figure 9:
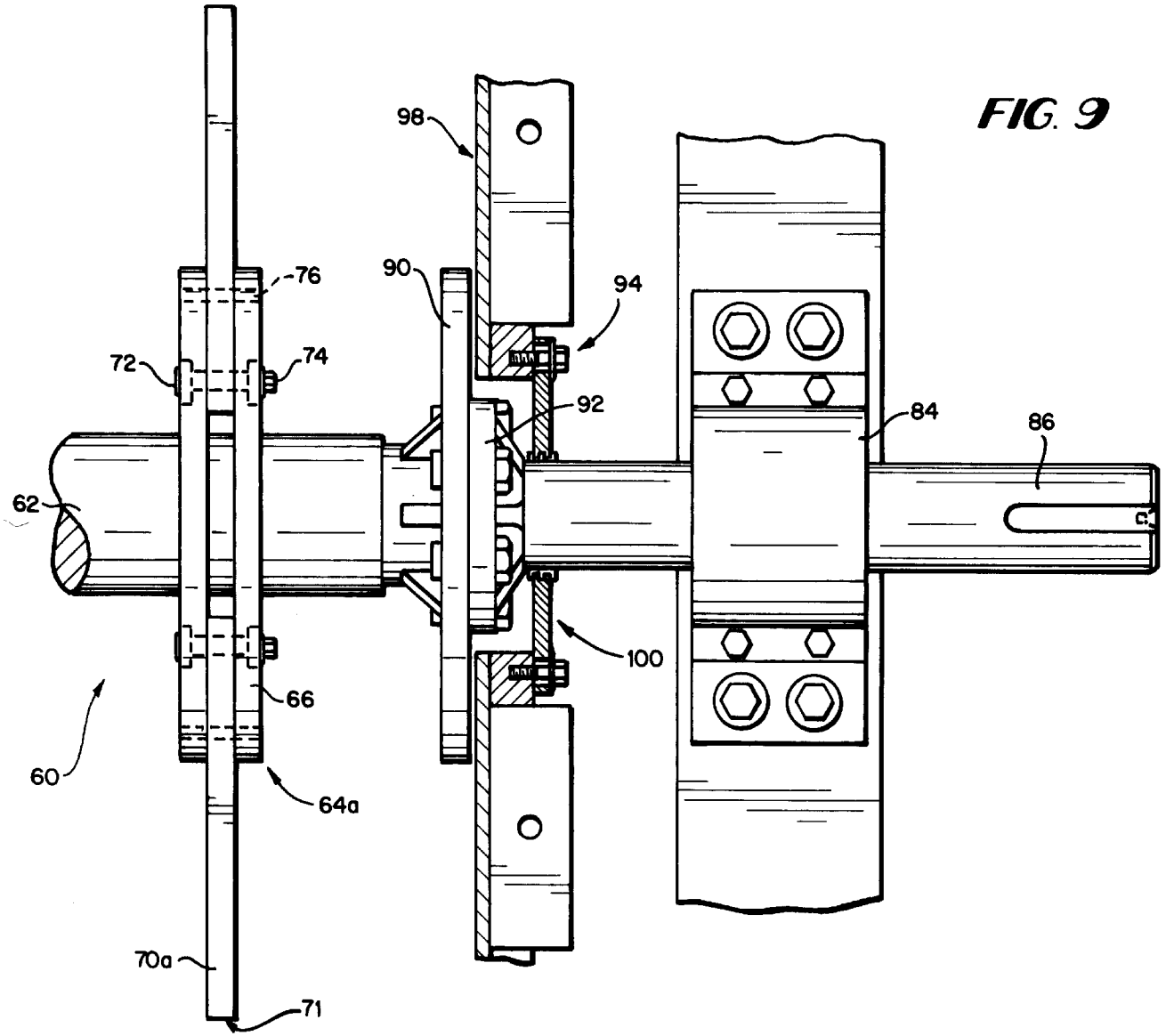
FIG. 9 is a fragmented top view showing the slinger and labyrinth seal of one rotor assembly in detail.
Figure 10A:
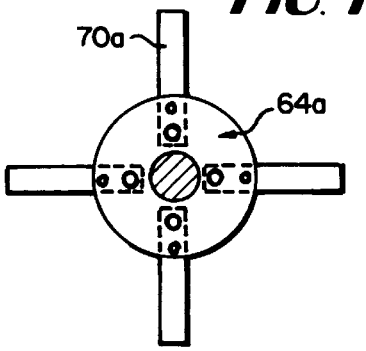
FIGS. 10*a* through 10*g* are schematic views of the thrust guide orientation of each disc set taken along lines 10*a* through 10*g*, respectively, of FIG. 8.
Figure 10B:
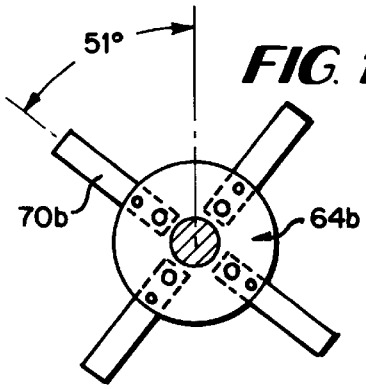
Figure 10C:
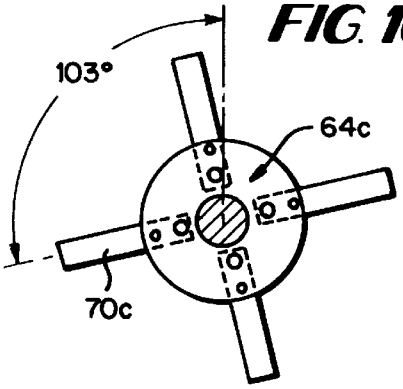
Figure 10D:
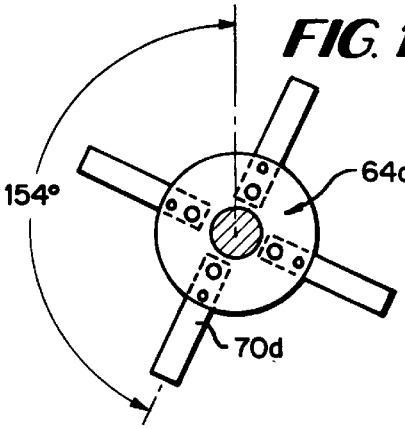
Figure 10E:
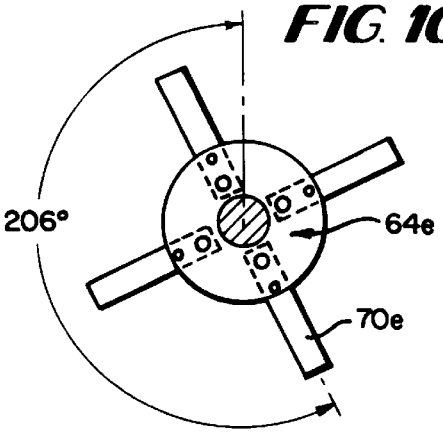
Figure 10F:
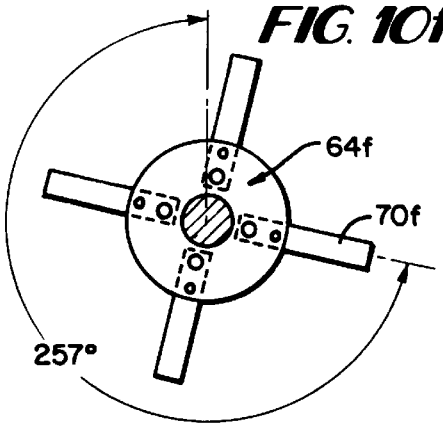
Figure 10G:
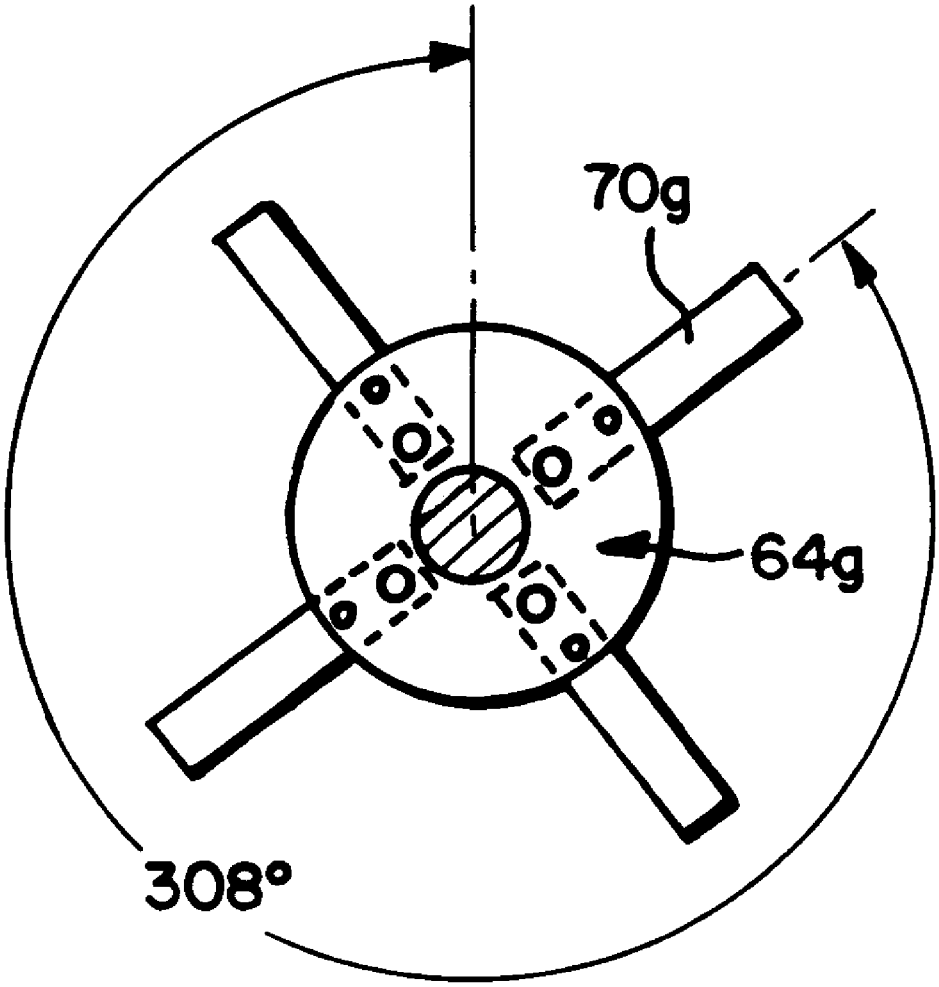

In FIGS. 8 and 9, only the disc sets 64 of rotor assembly 60 are shown for purposes of clarity. Each disc set 64 includes a pair of discs 66 which are welded or otherwise secured to a respective rotor 62, 63, and with one or more thrust guides 70 rigidly mounted between each pair of discs 66 by the use of countersunk bolts 72 and locking nuts 74, as well as by shear pins 76. In one embodiment of the invention, each disc 66 is one inch in thickness for added rigidity and improved wear life on the rotors. Each securing bolt 72 passes through openings in the discs 66 and in the thrust guide 70 whereupon it is secured by a locking nut 74. Each bolt 72 and nut 74 is countersunk into a respective disc 66 so as to decrease wear, as shown in FIGS. 8 and 9. Each thrust guide 70 is rigidly maintained between the disc pairs 66 by a shear pin 76 which is secured through openings in the discs and in the thrust guide 70. The shear pins 76 are inserted through the discs and thrust guide at a position radially outwardly of the bolt and lock nut.

The thrust guides 70 must be held rigidly between the disc pairs 66 so as to maintain full extension from the disc pairs and thereby rotate as closely as possible to the housing internal wall 56 or the wear plates 58. By rotating in close proximity to the housing internal wall 56 or the wear plates, the thrust guides 70 are unlikely to miss materials or particles which have become positioned along the housing internal walls and which could be missed by a thrust guide which has folded back during operation. In one embodiment of the invention, the thrust guides pass within about ½ to 1 inch of the internal wall. In a specific embodiment of the invention, the thrust guides pass approximately 11/16 inch from the internal wall.

The shear pins 76, which can be spiral spring pins, for example, are sufficiently strong to help maintain the thrust guides 70 in a substantially rigid position but can shear or break in the case of foreign objects entering the tank which are ungrindable by the collider. When a shear pin shears or breaks off, the corresponding thrust guide is allowed to fold back out of the way of the ungrindable material and thereby can avoid severe damage. It is also within the scope of the invention for the thrust guides to be rigidly mounted on a single disc rather than between a pair of discs.

As shown in FIGS. 8 and 9, the thrust guides 70 are in the form of elongated bars having outer ends 71 which may be of either chamfered or rectangular shape in cross section. In one embodiment of the invention, the thrust guides 70 are provided with a hard surfaced square tip for durability. In one embodiment of the invention, four thrust guides are rigidly mounted at approximately equal intervals around the radially outer surface of the disc sets. Mounting the thrust guides at approximately equally spaced intervals about the radially outer surface of the disc sets promotes proper balance during the operation of the collider. The amount by which the thrust guides 70 extend outwardly beyond the discs 66 may be varied by changing the length of the guides 70 or by changing the location at which the thrust guides 70 are rigidly connected to the discs 66, either radially inwardly or outwardly with respect to the discs 66.

Figure 7:
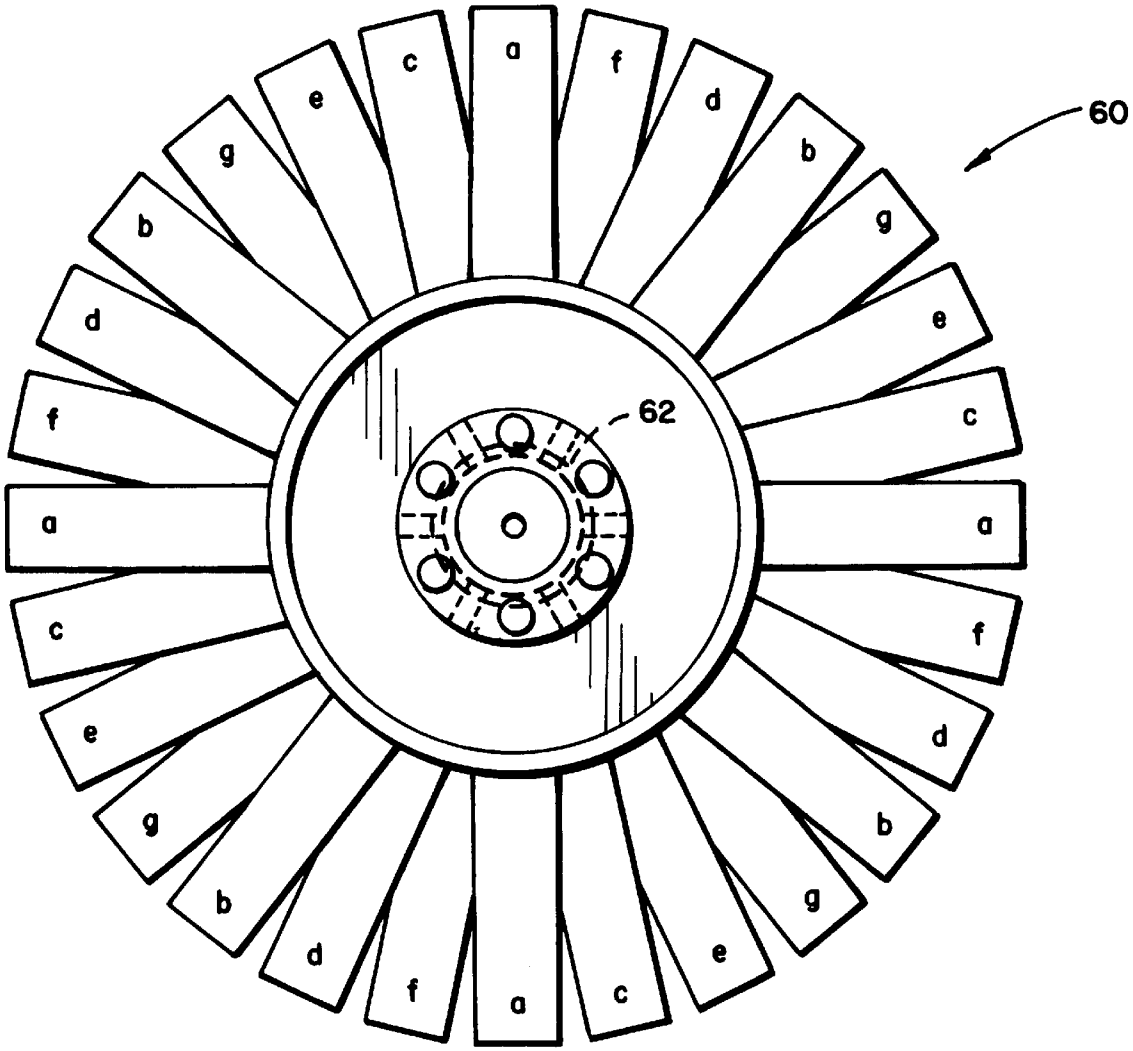
FIG. 7 is a right side schematic view of one rotor assembly of the present invention.

In the embodiment of the invention as shown in FIGS. 7, 8 and 10*a* through 10*g*, the thrust guides 70 are arranged to create a spiral pattern along the length of the rotor. To create this arrangement, the thrust guides 70 in each successive disc set 64 may be offset by a preselected angle in a counter-clockwise direction so as to form a complete 360 degree spiral pattern along the length of the rotor. This preselected angle is determined by the number of disc sets per rotor. In the embodiment as shown in FIGS. 7 and 8, wherein each rotor assembly includes seven disc sets, this offset angle may range from about fifty to about fifty-two degrees. In a specific embodiment including seven disc sets, an offset angle of approximately 51.43 degrees is employed. This angle ensures that the thrust guides form a complete 360 degree spiral pattern along the length of the rotor.

Thus, as shown in FIGS. 7, 8, and 10*a* through 10*g*, the first thrust guide 70*a* on disc set 64*a* is shown in a vertical position at an angle of 0 degrees in a 360 degree circle while thrust guide 70*b* on disc set 64*b* is positioned at an angle of approximately 51.43 degrees relative to the vertical and thrust guide 70*c* on disc set 64*c* is positioned at an angle of approximately 102.8 degrees relative to the vertical. From the feed end to the outlet end of the housing assembly, the spiral pattern extends in a direction opposite the direction of rotation of the given rotor assembly so as to assist in maintaining collider balance and obtaining maximum effectiveness of the thrust guides in circulating and pulverizing the slurry solid materials through the housing assembly. Additionally, the spiral pattern of the thrust guides allows for consistent movement of the material, better amperage regulation, and more efficient horsepower consumption during operation of the collider. The thrust guides 70 on counter rotating rotor assembly 61 may be arranged so as to be offset in a clockwise direction. It is also within the scope of the invention for the thrust guides of successive disc sets on the same rotor to be aligned in the same plane in a non-spiral pattern, as shown schematically in FIG. 1.

The rotor assemblies 60, 61 are freely rotatable in either direction and during operation of the material collider 10 will rotate in opposite or counter rotating directions with respect to each other. The thrust guides 70 may be of equal length as shown in FIG. 7 as well as of equal weight. Alternatively, the thrust guides 70 may vary in length and weight. For proper balance, however, opposing thrust guides on the same disc set are preferably the same length and weight.

The disc sets are arranged in an alternating pattern from feed end 13 to outlet end 15, as shown in FIG. 1, so that the first disc set 64 closest to the feed end 13 is on rotor 62 while the next closest disc set 64 to the feed end 13 is on rotor 63 and so on in an alternating relation back and forth from rotor 62 to rotor 63. Also, there is an overlap between the thrust guides 70 of the disc sets 64 carried by the two rotors 62, 63. In one embodiment, the overlap between thrust guides 70 of the two rotors 62 and 63 is from about fourteen to about fifteen inches. In a specific embodiment of the invention, the thrust guide overlap is approximately 14⅜ inches. The effect of the alternating, overlapping pattern is to produce an interdigitating configuration which assists in obtaining maximum circulating and colliding action.

Figure 4:
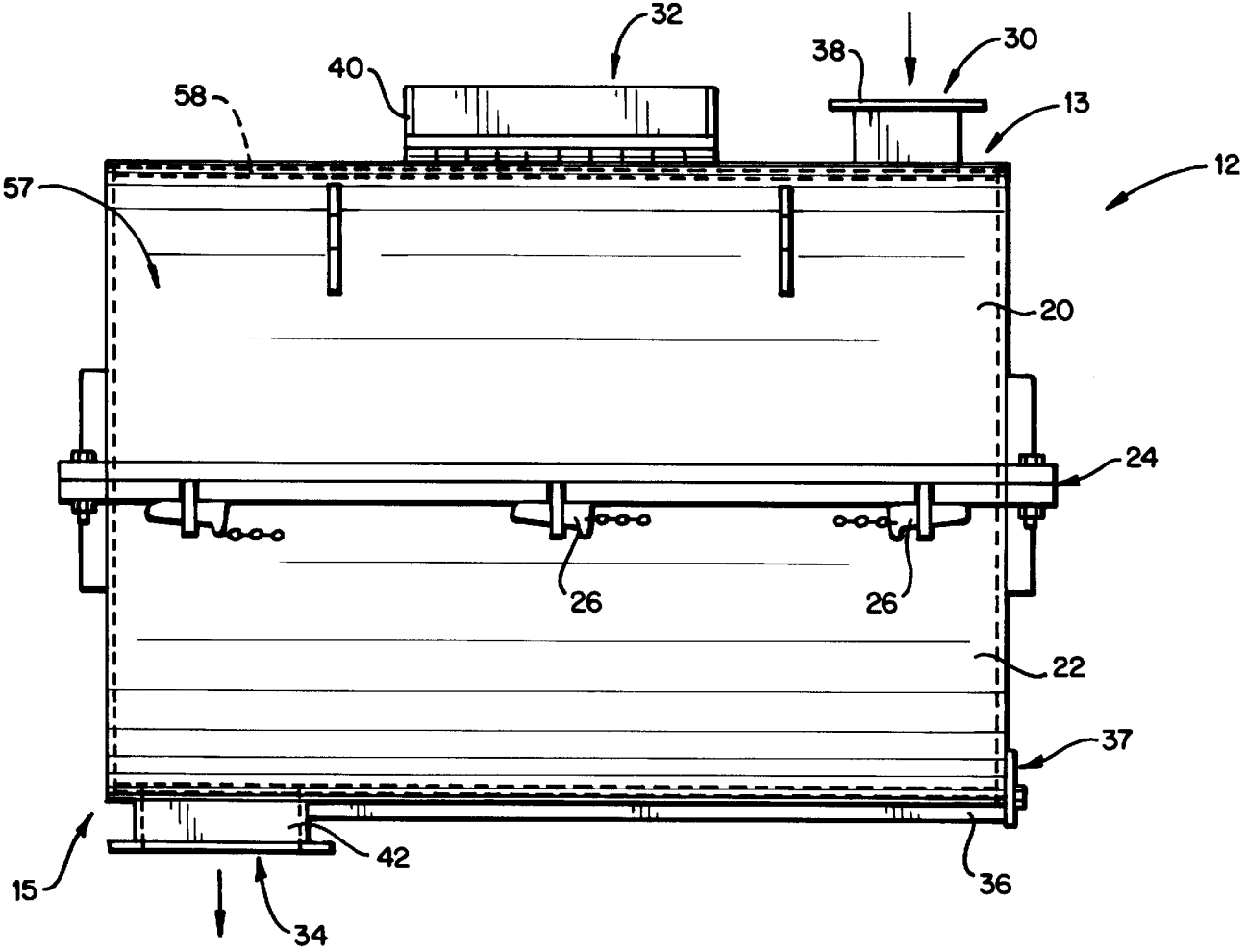
FIG. 4 is a front elevation view of the housing assembly of the present invention.

As shown in FIGS. 4 and 5, the housing assembly bottom section 22 includes a cleanout trough 36 which extends along the length of the cylindrical chambers 52, 54 and to a depth below that of the cylindrical chambers to collect ungrindable particles and prevent them from damaging the rotors and thrust guides. The cleanout trough 36 also works to protect the bottom wear liners 58 and the housing assembly 12 by allowing the materials to collect and build up somewhat within the trough 36 such that, during operation, the downward thrust of material will impact on the material in the trough rather than the liners and housing. A trough cleanout door 37 secured to one end of the cleanout trough 36 can be removed in order to allow removal any objects collected by the trough 36.

Figure 2:
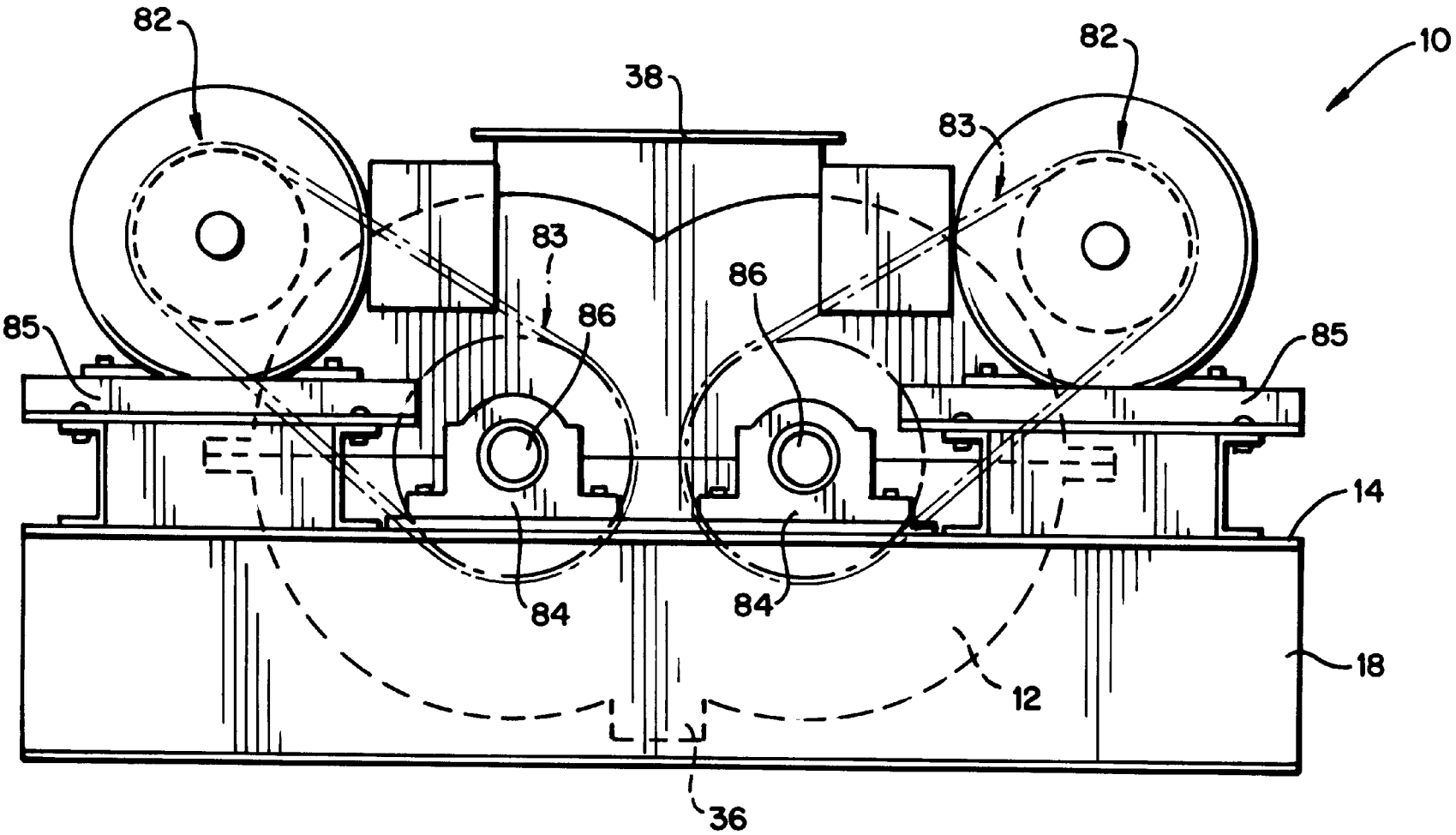
FIG. 2 is a right side schematic view of the collider of the present invention, showing the v-belt drives.
Figure 3:
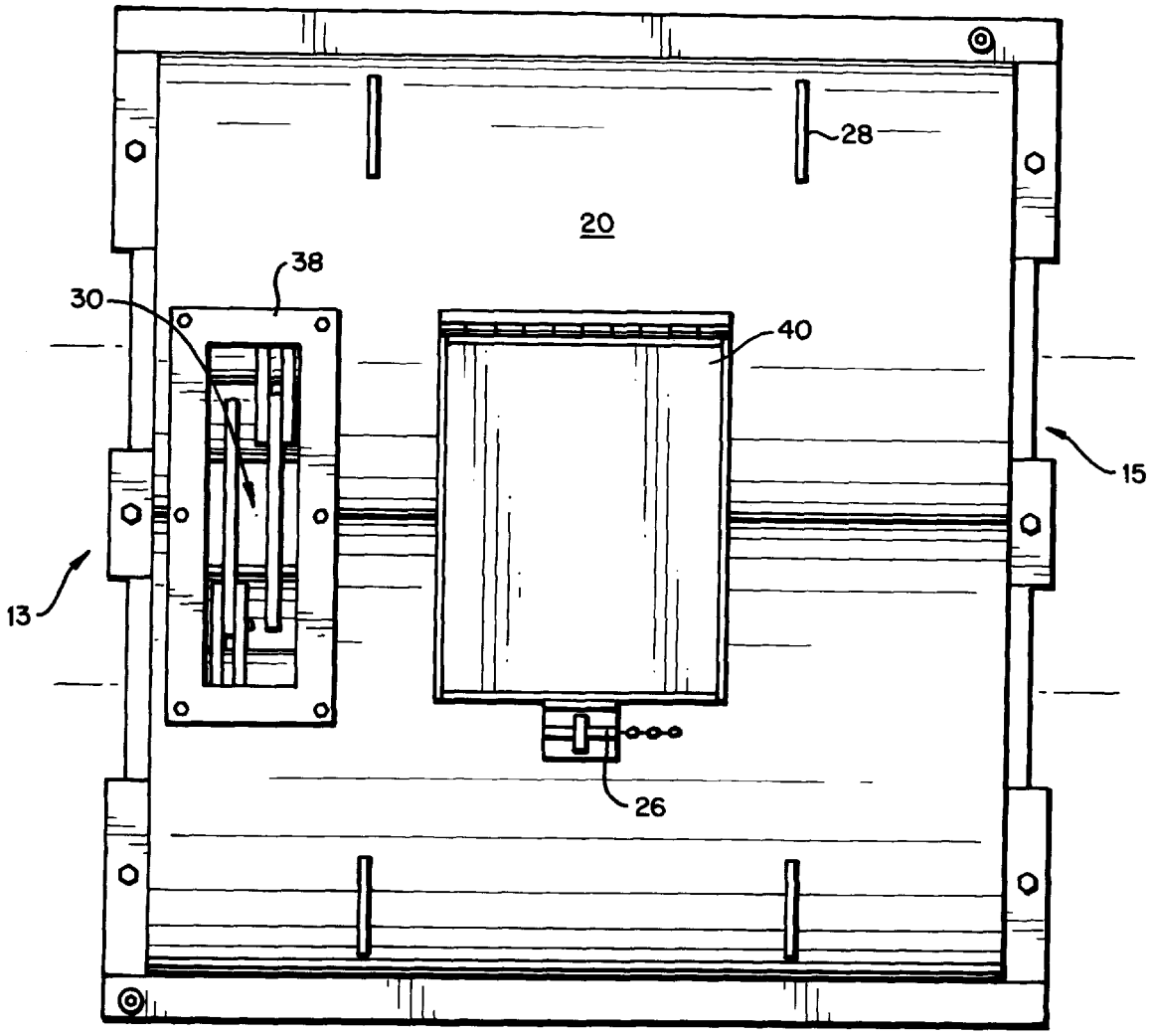
FIG. 3 is a top plan view of the housing assembly of the present invention.

As shown in FIGS. 1 and 2, a drive system including motors 82, pillowblock bearings 84, and drive 86 and stub 88 shafts is mounted to the baseframe assembly 14 to rotate the rotor assemblies 60, 61. The drive shafts 86 and stub shafts 88 are rotatably mounted within the pillowblock bearings 84 and are axially aligned with and coupled to an associated rotor assembly 60, 61. The pillowblock bearings 84 are securely mounted to the baseframe 14. In one embodiment of the invention, the drive 86 and stub 88 shafts are formed of 3 15/16 inch internal diameter AISI turned, ground, and polished heat treated steel for trueness of the shaft diameter and more precise balancing. As shown in FIGS. 1, 8, and 9, each rotor 62, 63 is provided with a slinger flange 90 at each axial end which mates with a corresponding flange 92 provided at the ends of the drive 86 and stub 88 shafts. The drive and stub shaft flanges 92 extend through respective shaft openings 94 in the housing assembly 12. The slinger flanges 90 are secured to the shaft flanges 92 at a position just inside each respective shaft opening 94. Each slinger flange 90 has a diameter larger than that of the shaft openings 94 and extends along the interior end walls 98 of the housing assembly 12 so as to help prevent materials within the housing assembly from escaping through the shaft openings 94 and flowing towards the shafts. In one embodiment, the slinger flanges 90 extend within approximately ¼ inch of the housing assembly interior end walls 98.

As shown in FIG. 9, a labyrinth seal 100 is secured to each shaft 86, 88 to further seal its respective shaft opening 94. The labyrinth seals 100 act to stop spillage of contaminated materials from the housing as well as to stop intrusion of contaminated materials onto the shaft bearings. Further, the labyrinth seals keep material from riding on the rotating shafts which can cause excessive shaft wear.

Each drive shaft is operated by a respective 300 horsepower motor 82 and v-belt drive 83, with each motor being controlled through a separate control breaker panel. The control panels may be enclosed in NEMA enclosures, for example, and may include soft start devices to provide a controlled start up load on the electrical supply. A v-belt guard 104 is secured to the baseframe to protect the v-belts during operation. In one embodiment of the invention, eight synchronous v-belts are employed per motor. The motors 82 are each mounted atop a slide base 85 which can be moved towards or away from the respective drive shaft 86 to vary the v-belt tension. For example, during maintenance or replacement of collider components which requires the drive system to be disengaged, the slide bases 85 can move the motors 82 towards the drive shafts 86 to loosen the v-belts so as to allow the v-belts to slide off the drive shaft 86. The v-belt drives are easy to install and maintain while allowing the rotor rpm to be easily varied and also allowing the belts to slip in an overload situation to prevent damage to the motors. Additionally, a vibration switch and an emergency stop button may be employed to automatically turn off power to the collider in instances of unforeseen imbalance, a clogged inlet or outlet, or other instance in which damage to the collider may occur.

In one embodiment of the present invention, the length of the collider 10 is approximately 145 inches, the width approximately 100 inches, and the height approximately 48 inches. However, the collider 10 can range in size up to twice these dimensions or even larger, depending on the requirements of the operating conditions for the machine. The collider is portable and is sized so as to provide the proper reduction in particle size, based on the housing diameter and the tip speed generated by the motors.

While the invention contemplates using any number of disc sets per rotor, the number of disc sets and the overall size of the rotor assemblies and the housing assembly will dictate the size of the motors needed to maintain the collider in good operating balance. Three hundred horsepower motors have been found optimal for driving seven disc sets on each rotor.

In operation, material such as drill cuttings from a wellbore is fed into the collider 10 in slurry form through the feed inlet chute 38 at the top of the feed end 13 of the housing assembly where it is mixed with water injected through an input port in the feed inlet chute. Generally, such drill cuttings will contain particles of a size larger than 50 mesh. Once inside the housing assembly, the particles contained in the drill cuttings are broken up by continual collisions with one another, caused by the action of the counter rotating shafts 86 which turn the rotor assemblies 60, 61 and thereby the disc sets 64 in opposite rotational relation so that the thrust guides 70 carried by rotor assembly 60 interengage with the thrust guides 70 on the other rotor assembly 61 in an overlapping, interdigitating manner, as previously discussed. Generally, the two rotors 60, 61 will operate at the same rpm, in the range of 1400 to 1900 rpm, so that the thrust guides 70 will rotate fast enough to maintain the rock or other particles in the slurry and allow the solid material in the slurry to impact upon itself rather than dropping out of the slurry.

The action of the thrust guides 70 spins the slurry materials, and forces the slurry solid particles to collide with one another so as to break into smaller pieces. This process continues until the material reaches the material discharge 34 where it then flows out of the chambers 52, 54 to be used for reinjection into the wellbore. The intermeshing of the thrust guides 70 and their positioning on the disc sets 64 of each shaft 60, 61 act to properly balance the collider 10 when in use so that vibration of the collider 10 is minimal.

Generally, only one pass through the collider is required in order to reduce the cuttings to the desired size. The cuttings are mainly broken up by the continual collisions of the solid particles with one another. By encouraging the materials to break up through collisions with one another and not with the rotor assemblies, the collider of the present invention can increase the lifespan of the rotor assemblies and the wear plates lining the housing interior. If the collider should encounter any ungrindable materials, the thrust guides may avoid damage by shearing the respective shear pin and folding back out of the way. Any ungrindables falling through the rotor assemblies will be collected in the cleanout trough.

While the invention has been described as being particularly well suited for use in pulverizing the solid materials in drilling mud and waste from well drilling operations, it is also within the scope of the invention to employ the present apparatus in pulverizing various agricultural products such as pecan shells and various types of minerals.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A material collider apparatus for producing finely ground material, comprising:

a baseframe assembly including a housing cavity;

a housing assembly secured to said baseframe assembly so as to rest at least partially within said baseframe housing cavity, said housing assembly being formed by a pair of interconnected cylindrical chambers which are in fluid communication and in overlapping relation along the length thereof;

a pair of rotor assemblies each having a rotor, with one rotor being rotatably maintained coaxially in each cylindrical chamber, said rotors extending in parallel relation throughout the length of the chambers, each rotor assembly further including a plurality of disc members secured to each rotor, said disc members extending generally transverse to the longitudinal axis of the chambers, and at least one thrust guide member in the form of an elongated bar or rod rigidly secured to at least one disc member, said at least one thrust guide member having a pair of radially aligned openings and being rigidly secured to said at least one disc member by securing means which includes a shear pin inserted through the radially outermost opening of said thrust guide member; and means for rotating said rotor assemblies.

2. The apparatus of claim 1 wherein said housing assembly includes feed and outlet ends and a top and bottom portion, said housing assembly further including an inlet for receiving feed material on said top portion proximate said feed end and a material discharge opening on said bottom portion proximate said outlet end.

3. The apparatus of claim 2 wherein said housing assembly top portion includes an inspection opening and wherein an inspection door is hingedly secured to said housing assembly top portion above said inspection opening.

4. The housing assembly of claim 2 wherein said housing assembly bottom portion includes a material outlet.

5. The apparatus of claim 2 wherein said housing assembly bottom portion includes a cleanout trough extending along the length of said cylindrical chambers.

6. The apparatus of claim 5 wherein a cleanout door is removably secured to one end of said cleanout trough.

7. The apparatus of claim 2 wherein said rotor assemblies include a plurality of thrust guides mounted on each disc member and wherein, for each rotor assembly, the thrust guides are arranged in a spiral pattern along the length of said rotor assembly.

8. The apparatus of claim 7 wherein, for each rotor assembly, said spiral pattern extends from said feed end to said outlet end of said housing asembly in the direction opposite the intended direction of rotation of said rotor assembly.

9. The apparatus of claim 2 wherein, for a given rotor assembly, said thrust guides of a given disc member are offset from the thrust guides of the disc member next preceding said given disc member by a preselected angle about the longitudinal axis of said given rotor assembly in a direction counter to the intended direction of rotation of said given rotor assembly so as to form a spiral pattern along the length of said given rotor assembly.

10. The apparatus of claim 9 wherein said preselected angle is determined by the number of disc members on said given rotor assembly.

11. The apparatus of claim 9 wherein said spiral pattern is a 360 degree spiral pattern extending along the length of said given rotor assembly.

12. The apparatus of claim 9 wherein each rotor assembly includes seven disc members and each disc member includes four thrust guides.

13. The apparatus of claim 12 wherein said preselected angle is from approximately fifty to approximately fifty-two degrees.

14. The apparatus of claim 12 wherein said preselected angle is approximately 51.4 degrees.

15. The apparatus of claim 2 wherein said housing assembly top portion has a plurality of lift eyes so as to allow said top portion to be removed from said bottom portion.

16. The apparatus of claim 2 wherein said rotors each have a longitudinal axis and wherein a seal is positioned between said top and bottom portions, said seal lying coplanar with said axes of said rotors.

17. The apparatus of claim 2 wherein said housing assembly includes a pair of shaft openings at each of said feed and outlet ends, said shaft openings being axially aligned with a respective one of said rotor assemblies, and further wherein said rotating means includes a pair of motors mounted to said baseframe, a pair of drive shafts rotatably mounted to said baseframe, each of said drive shafts being operatively secured to a respective one of said pair of motors by drive means, a pair of stub shafts rotatably mounted to said baseframe, each of said drive and stub shafts having an axially outer end, and means for coupling said drive shafts and stub shafts to a respective rotor assembly.

18. The apparatus of claim 17 wherein said pair of motors is slidably mounted to said baseframe.

19. The apparatus of claim 17 wherein said drive means includes belt drives.

20. The apparatus of claim 17 further including sealing means for preventing back flow of material around said shafts.

21. The apparatus of claim 20 wherein each of said rotor assemblies has an axial drive end and an axial stub end and wherein said sealing means includes slinger flanges on each of said ends of said rotor assemblies which are coupled to a respective flange on said outer axial ends of each of said drive and stub shafts, said sealing means further including a labyrinth seal mounted to each drive and stub shaft at a position axially inwardly of said outer axial ends of said shafts.

22. The apparatus of claim 20 wherein each of said rotor assemblies has an axial drive end and an axial stub end and wherein said sealing means includes slinger flanges on each of said ends of said rotor assemblies which are coupled to a respective flange on said outer axial ends of each of said drive and stub shafts.

23. The apparatus of claim 22 wherein said slinger flanges have a diameter larger than said housing shaft openings and are coupled to the shaft flanges such that each slinger flange extends parallel to the interior end walls of said housing assembly within said housing assembly at a distance of less than one quarter inch from said interior end walls.

24. The apparatus of claim 23 wherein said coupling means includes bolts and lock nuts for securing each of said drive and stub shaft flanges to a respective one of said rotor assembly slinger flanges.

25. The apparatus of claim 22 wherein said sealing means includes a labyrinth seal mounted to each drive and stub shaft at a position axially inwardly of said outer axial ends of said shafts.

26. The apparatus of claim 1 wherein said means for rotating said pair of shafts includes means for rotating said shafts in a counter rotating relation.

27. The apparatus of claim 1 wherein said rotor members are mounted so that the thrust guides of the respective disc members will overlap and interdigitate in a direction along the longitudinal axis of said rotor assemblies.

28. The apparatus of claim 1 wherein said chambers are lined with abrasion resistant steel wear plates.

29. The apparatus of claim 1 wherein the outer end portion of said at least one thrust guide member passes within approximately ½ to 1 inch of the interior wall surfaces of the respective chamber.

30. A material collider apparatus for producing finely ground material, comprising:

a baseframe assembly including a housing cavity;

a housing assembly secured to said baseframe assembly so as to rest at least partially within said baseframe housing cavity, said housing assembly being formed by a pair of interconnected cylindrical chambers which are in fluid communication and in overlapping relation along the length thereof, said housing assembly including a top portion, a bottom portion, and a cleanout trough portion extending along the length of said cylindrical chambers on said bottom portion;

a pair of rotor assemblies each having a rotor, with one rotor being rotatably maintained coaxially in each cylindrical chamber, said rotors extending in parallel relation throughout the length of the chambers, each rotor assembly further including a plurality of disc members secured to each rotor, said disc members extending generally transverse to the longitudinal axis of the chambers, and at least one thrust guide member in the form of an elongated bar or rod rigidly secured to at least one disc member, said at least one thrust guide member having a pair of radially aligned openings and being rigidly secured to said at least one disc member by securing means which includes a shear pin inserted through the radially outermost opening of said thrust guide member; and means for rotating said rotor assemblies.

31. The apparatus of claim 30 wherein said cleanout trough extends below said cylindrical chambers.

32. A material collider apparatus for producing finely ground material, comprising:

a baseframe assembly including a housing cavity;

a housing assembly secured to said baseframe assembly so as to rest at least partially within said baseframe housing cavity, said housing assembly being formed by a pair of interconnected cylindrical chambers which are in fluid communication and in overlapping relation along the length thereof;

a pair of rotor assemblies each having a rotor, with one rotor being rotatably maintained coaxially in each cylindrical chamber, said rotors extending in parallel relation throughout the length of the chambers, each rotor assembly further including a plurality of disc members secured to each rotor, said disc members extending generally transverse to the longitudinal axis of the chambers, and a plurality of thrust guide members in the form of elongated bars or rods rigidly mounted at approximately equal intervals about the periphery of each of said disc members such that from the feed end to the outlet end for a given rotor assembly, said thrust guides of a given disc member are offset from the thrust guides of the disc member next preceding said given disc member by a preselected angle about the longitudinal axis of said given rotor assembly in a direction counter to the intended rotation of said given rotor assembly so as to give each rotor assembly a plurality of spiralled patterns of thrust guides along the length of each rotor assembly, the number of spiralled patterns being equal to the number of thrust guides per disc member, and wherein each of said thrust guides has a pair of radially aligned openings and being rigidly secured to a respective disc member by securing means which includes a shear pin inserted through the radially outermost opening of said thrust guide member; and means for rotating said rotor assemblies.

33. The apparatus of claim 32 including seven disc members per rotor and four thrust guides per disc member and wherein the preselected angle is approximately 51.4 degrees.

34. A material collider apparatus for producing finely ground materials, comprising:

a baseframe including a housing cavity;

a housing assembly secured to said baseframe so as to rest at least partially within said baseframe housing cavity, said housing assembly formed by a pair of interconnected cylindrical chambers which are in fluid communication and in overlapping relation along the length thereof, said housing assembly having an interior surface, a feed end, an outlet end, and a top and bottom portion, said housing assembly further including an inlet for receiving feed material on said top portion proximate said first end and a material discharge opening on said bottom portion proximate said second end, said housing assembly further including a cleanout trough portion extending along the length of said cylindrical chambers on said bottom portion and a pair of shaft openings at each of said first and second ends;

a pair of motors secured to said baseframe;

a pair of drive shafts rotatably mounted to said baseframe, each drive shaft being operatively connected to a respective one of said pair of motors by drive means, each drive shaft having a flange at an axially outer end thereof;

a pair of stub shafts rotatably mounted to said baseframe, each of said stub shafts including a flange at an axially outer end thereof;

a pair of rotor assemblies each having a rotor, with one rotor being rotatably maintained coaxially in each cylindrical chamber so as to be axially aligned with said shaft openings, said rotors extending in parallel relation throughout the length of the chambers and having a slinger flange secured to the axially outer ends thereof, said slinger flanges being secured to said drive and stub shaft flanges so as to maintain said rotor assemblies securely within said housing assembly, said slinger flanges having a diameter larger than said housing shaft openings and being coupled to the shaft flanges such that each slinger flange extends parallel to the interior end walls of the housing assembly within said housing assembly interior, said rotor assemblies further including a plurality of disc members secured to each of said rotors, said disc members extending generally transverse to the longitudinal axis of the chambers, a plurality of thrust guide members in the form of elongated bars or rods rigidly mounted at approximately equal intervals about the periphery of each of said disc members such that from the feed end to the outlet end for a given rotor assembly, said thrust guides of a given disc member are offset from the thrust guides of the disc member next preceding said given disc member by a preselected angle about the longitudinal axis of said given rotor assembly in a direction counter to the intended rotation of said given rotor assembly so as to give each rotor assembly a plurality of spiralled patterns of thrust guides along the length of each rotor assembly, the number of spiralled patterns being equal to the number of thrust guides per disc member, and wherein each of said thrust guides has a pair of radially aligned openings and being rigidly secured to a respective disc member by securing means which includes a shear pin inserted through the radially outermost opening of said thrust guide member; and a labyrinth seal rotatably mounted to each of said drive and stub shafts at a position axially inward of said drive and stub shaft flanges.

* * * * *